United States Patent [19]

Rosenthal

[11] Patent Number: 4,736,974

[45] Date of Patent: Apr. 12, 1988

[54] PORTABLE WINDOW STOP

[76] Inventor: Mark D. Rosenthal, 225 W. Walnut St., Long Beach, N.Y. 11561

[21] Appl. No.: 12,639

[22] Filed: Feb. 9, 1987

[51] Int. Cl.[4] ..... E05C 17/54

[52] U.S. Cl. ..... 292/343; 292/342; 292/DIG. 15; 292/DIG. 47; 292/DIG. 73; 292/143

[58] Field of Search ..... 292/343, 342, DIG. 15, 292/355, 40, 143, 336.3, DIG. 20, DIG. 47, DIG. 73

[56] References Cited

U.S. PATENT DOCUMENTS

| | | | |
|---|---|---|---|
| 85,345 | 12/1868 | Sullenberger | 292/342 |
| 405,319 | 6/1889 | Nageborn | 292/342 X |
| 1,048,401 | 12/1912 | Flaniken | 292/342 |
| 1,138,242 | 5/1915 | Olson | 292/342 |
| 1,159,637 | 11/1915 | Adickes, Jr. | 292/342 |
| 1,297,189 | 3/1919 | Lawler | 292/342 |
| 1,500,130 | 7/1924 | Heringer | 292/342 |
| 1,676,284 | 7/1928 | Powell | 292/343 |
| 2,143,266 | 1/1939 | Grondahl | 292/342 |
| 2,205,614 | 6/1940 | Bashe | 292/342 |
| 2,472,216 | 6/1949 | Kasik | 292/343 |

*Primary Examiner*—Gary L. Smith
*Assistant Examiner*—Carl M. DeFranco, Jr.
*Attorney, Agent, or Firm*—Michael I. Kroll

[57] ABSTRACT

A keyless lock for a window, sliding door and the like is provided and is in a wedge shaped configuration so as to fit between two parts of the window and sliding door to prevent opening thereof.

6 Claims, 1 Drawing Sheet

PORTABLE WINDOW STOP

BACKGROUND OF THE INVENTION

1. Field of the Invention

The instant invention relates generally to locking devices and more specifically it relates to a keyless lock.

2. Description of the Prior Art

Numerous locking devices have been provided in prior art that are adapted to be permanently attached to windows, doors and the like for locking them without using keys. For example, U.S. Pat. Nos. 3,907,348; 4,099,756 and 4,436,328 all are illustrative of such prior art. While these units may be suitable for the particular purpose to which they address, they would not be as suitable for the purposes of the present invention as heretofore described.

SUMMARY OF THE INVENTION

A primary object of the present invention is to provide a keyless lock that will overcome the shortcomings of the prior art devices.

Another object is to provide a keyless lock for a window or sliding door that is wedge shaped to fit between two parts of the window or sliding door to prevent opening thereof.

An additional object is to provide a keyless lock that can be removably installed to the window or sliding door without the use of tools, screws, nails and drilling in which no holes or damage will occur.

A further object is to provide a keyless lock that is simple and easy to use.

A still further object is to provide a keyless lock that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
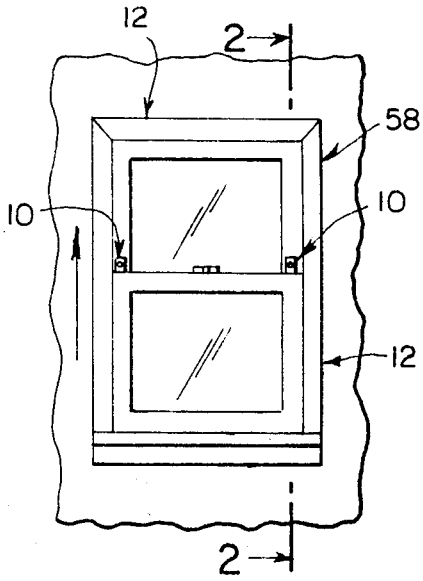
FIG. 1 is a front elevational view of a double hung window with invention in place between two parts thereof.
Figure 2:
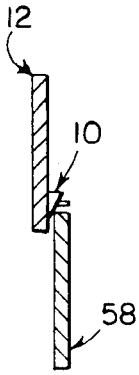
FIG. 2 is a cross sectional view taken along line 2—2 in FIG. 1.

Turning now descriptively to the drawings, in which similar reference characters denote similar elements throughout the several views, FIGS. 1 through 7 illustrate a keyless lock 10 for two sliding frame members

12. The lock 10 includes a wedge shaped body 14 to be removably installed between the two sliding frame members 12. A friction switch 16 is provided for releasably securing the wedge shaped body 14 in place between the two frame members 12 to prevent opening of the two sliding frame members.

The friction switch 16 is mounted within the wedge shaped body 14 so that when the wedge shaped body is placed between the two sliding frame members 12 the friction switch 16 in a first position will hold the wedge shaped body 14 thereto. The friction switch in a second position will release the wedge shaped body therefrom.

The friction switch 16 includes the wedge shaped body 14 having a transverse aperture 18 therethrough and a cutout step 20 in bottom 22 thereof. An arm 24 is provided that has a central slot 26 whereby the arm extends through the aperture 18 and into the cutout step 20 in the wedge shaped body. A first pin 28 extends transversely through the central slot 26 of the arm 24 and into the wedge shaped body 14 so that the arm can pivotly move within the aperture 18. A sliding cover 30 with a low friction top surface 32 has a hole 34 therethrough is placed against the cutout step 20 in the wedge shaped body. A gripping member 36 with a high friction bottom surface 38 has a hole 40 therethrough is placed within the sliding cover 30. A second pin 42 extends transversely through distal end 44 of the arm 24, the gripping member 36 and the sliding cover 30 so that the top surface 32 of the sliding cover can slide against the cutout step 20 while the bottom surface 38 of the gripping member can hold against one of the two sliding frame members 12 thus allowing tip 46 of the wedge shaped body 14 to go under other of the two sliding frame members 12 when the arm 24 is manually moved into the first position.

The wedge shaped body 14 also has a recess 48 with narrow mouth 50 which extends upwardly from the cutout step 20 in the bottom 22. A compression spring 52 is placed within the recess 48 to bias a ball 54 downwardly against the narrow mouth 50 therein. The sliding cover 30 has a plurality of spaced apart indents 56 therein, each of which can receive the ball 54 when the arm 24 is manually moved into the first position and the second position.

Figure 3:
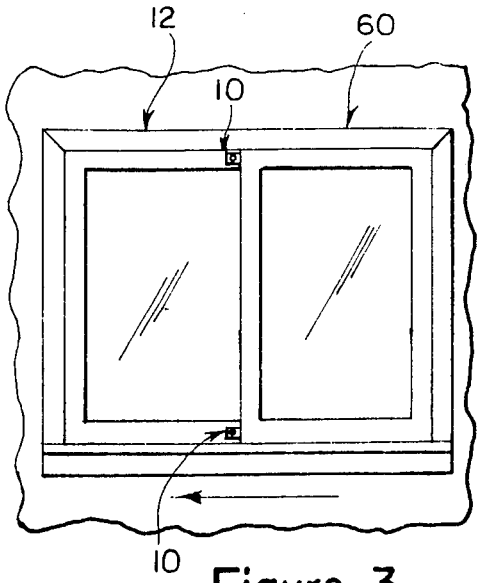
FIG. 3 is a front elevational view of a sliding window with invention in place between two parts thereof.
Figure 4:
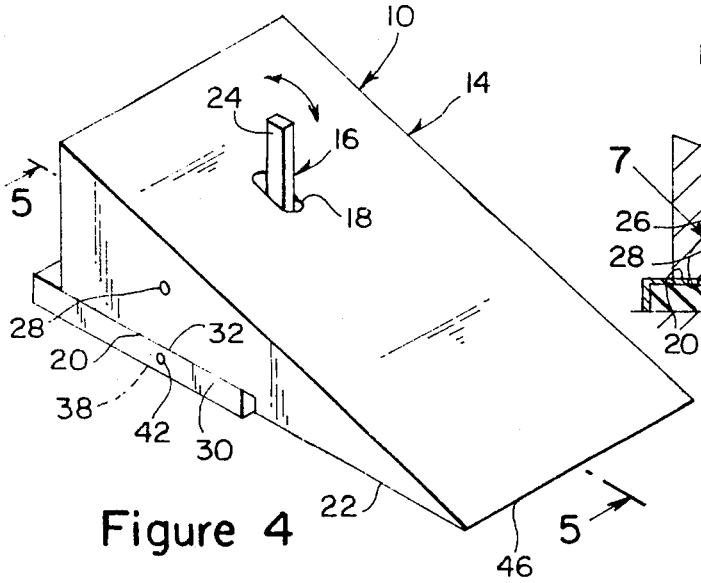
FIG. 4 is an enlarged perspective view of the invention.
Figure 5:
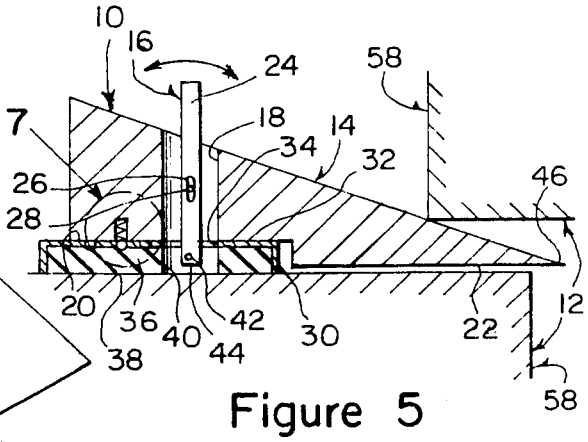
FIG. 5 is a cross sectional view taken along line 5—5 in FIG. 4 shown in place between the double hung window.
Figure 6:
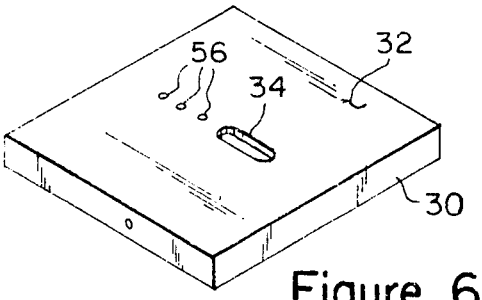
FIG. 6 is a perspective view of the slide cover.
Figure 7:
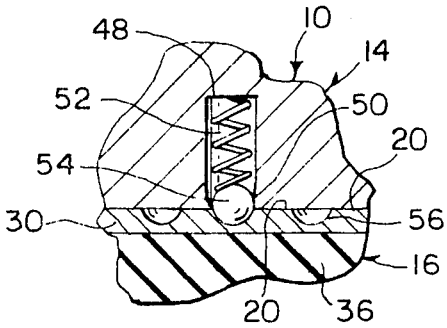
FIG. 7 is an enlarged cross sectional view as indicated by numeral 7 in FIG. 5.

The two sliding frame members 12 are a double hung window structure 58 as shown in FIG. 1. In FIG. 3 the two sliding frame members 12 are a sliding window structure 60. They can also be a sliding door structure (not shown). For best results two keyless locks 10 are utilized for proper balance.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A keyless lock for two sliding frame members, comprising:

(a) a wedge shaped body having a bottom with a cutout step;

(b) a sliding cover having a low friction top surface and being disposed within said cutout step of said bottom of said wedge shaped body;

(c) a gripping member having a high friction bottom surface and being disposed within said sliding cover; and (d) means pivotally mounted on said gripping member for engaging and moving said wedge shaped body relative to said gripping member so as to allow said top surface of said sliding cover to slide against said cutout step of said bottom of said wedged shaped body while said bottom surface of said gripping member remains stationary against a one of the two sliding frame members causing said wedge shaped body to move under the other one of the two sliding frame members so that said wedge shaped body is securely wedged between the two frame members and prevents movement of either of the two sliding frame members.

2. A keyless lock as recited in claim 1, wherein said wedge shaping body has an aperture therethrough and said moving means includes:

(a) an arm pivotally mounted to said wedge shaped body and extending through said aperture in said wedge shaped body and into said cutout step in said wedge shaped body;

(b) a sliding cover having a hole therethrough; and (c) a gripping member having a hole therethrough.

3. A keyless lock as recited in claim 2, wherein said moving means further includes:

(a) a first pin extending transversely through said central slot of said arm into said wedge shaped body so that said arm can pivotly move within said aperture; and (b) a second pin extending transversely through distal end of said arm, said gripping member and said sliding cover so that the top surface of said sliding cover can slide against said cutout step while the bottom surface of said gripping member can hold against one of the two sliding frame members thus allowing tip of said wedge shaped body to go under other of the two sliding frame members when said arm is manually moved into the first position.

4. A keyless lock as recited in claim 2, further comprising:

(a) said wedge shaped body having a recess with narrow mouth extending upwardly from the cutout step in the bottom;

(b) a compression spring placed within the recess;

(c) a ball biased downwardly within the recess by said spring against the narrow mouth therein; and (d) said sliding cover having a plurality of spaced apart indents therein, each of which can receive said ball when said arm is manually moved into the first position and the second position.

5. A keyless lock as recited in claim 4, wherein the two sliding frame members are double hung window structure.

6. A keyless lock as recited in claim 4, wherein the two sliding frame members are included in a sliding window structure.

* * * * *